US009938766B2

(12) United States Patent
Cordani

(10) Patent No.: US 9,938,766 B2
(45) Date of Patent: Apr. 10, 2018

(54) FLUID DISPENSING LADDER

(71) Applicant: GelTech Solutions, Inc., Jupiter, FL (US)

(72) Inventor: Peter Cordani, Palm Beach Gardens, FL (US)

(73) Assignee: GelTech Solutions, Inc., Jupiter, FL (US)

( * ) Notice: Subject to any disclaimer, the term of this patent is extended or adjusted under 35 U.S.C. 154(b) by 0 days.

(21) Appl. No.: 14/309,268

(22) Filed: Jun. 19, 2014

(65) Prior Publication Data

US 2014/0299412 A1 Oct. 9, 2014

Related U.S. Application Data

(63) Continuation-in-part of application No. 13/943,526, filed on Jul. 16, 2013, now Pat. No. 9,072,922.

(60) Provisional application No. 61/758,594, filed on Jan. 30, 2013.

(51) Int. Cl.

| | |
|---|---|
| ***E06C 7/00*** | (2006.01) |
| ***A62C 31/24*** | (2006.01) |
| ***A62B 5/00*** | (2006.01) |

(52) U.S. Cl.

CPC ..... *E06C 7/00* (2013.01); *A62B 5/00* (2013.01); *A62C 31/24* (2013.01)

(58) Field of Classification Search

CPC ..... E06C 7/08; A62C 13/78; A62C 3/00

See application file for complete search history.

(56) References Cited

U.S. PATENT DOCUMENTS

| | | | | | |
|---|---|---|---|---|---|
| 724,953 | A * | 4/1903 | Schaller | E06C 1/381 | 182/178.3 |
| 3,072,131 | A * | 1/1963 | Di Laurenzio | B60S 3/04 | 134/123 |
| 4,007,793 | A * | 2/1977 | Hux | A62C 31/24 | 169/25 |
| 4,428,434 | A * | 1/1984 | Gelaude | A62C 3/00 | 137/624.11 |
| 4,766,525 | A * | 8/1988 | Loughlin | A62B 5/00 | 182/18 |
| 4,961,535 | A * | 10/1990 | Skibik | A47C 1/14 | 239/279 |

(Continued)

FOREIGN PATENT DOCUMENTS

KR 101521027 B1 * 5/2015

*Primary Examiner* — Katherine W Mitchell
*Assistant Examiner* — Candace L Bradford
(74) *Attorney, Agent, or Firm* — McHale & Slavin, P.A.

(57) ABSTRACT

A safety ladder for protecting a lineman or firefighter from a flash fire. The ladder has the appearance of a conventional ladder but include fluid conduits that allow for dispensing of a fire suppressants to be sprayed over an individual using the ladder should a fire erupt. The rungs of the ladder have spray nozzles located along the bottom of the rung so that they do not interfere with normal use of the ladder. A pressurized container of fire suppressants is coupled to the ladder, through a battery powered solenoid valve. The solenoid valve can be operated by the individual using the ladder by use of a triggering device, or remotely by an individual positioned apart from the ladder by a remote triggering device. The triggering device can be operated electrically or by radio frequency, can be temperature sensitive, or can be manually bypassed.

8 Claims, 11 Drawing Sheets

(56) References Cited

U.S. PATENT DOCUMENTS 4,978,460 A 12/1990 Von Blucher et al.
5,087,513 A 2/1992 Kim
5,188,184 A * 2/1993 Northill ..... A62C 35/64 169/20
5,190,110 A 3/1993 Von Blucher et al.
5,519,088 A 5/1996 Itoh et al.
5,692,581 A * 12/1997 Nelson ..... E06C 7/08 182/129
5,849,210 A 12/1998 Pascente et al.
5,989,446 A 11/1999 Hicks et al.
6,367,584 B1 * 4/2002 Edwards ..... E04H 4/144 182/129
6,372,842 B1 4/2002 Grisso et al.
6,834,728 B2 12/2004 Demole
6,874,598 B1 * 4/2005 Baker ..... E06C 1/38 182/165
7,096,965 B2 8/2006 Ozment
7,104,336 B2 9/2006 Ozment
7,124,834 B2 10/2006 Sundholm et al.
7,169,843 B2 1/2007 Smith et al.
8,127,891 B1 * 3/2012 Gudinas, Jr. ..... A61H 35/006 182/129
2005/0209747 A1 * 9/2005 Yakes ..... B60K 1/02 701/22
2006/0065411 A1 * 3/2006 Linsmeier ..... A62C 27/00 169/24
2007/0114046 A1 * 5/2007 Munroe ..... A62C 5/02 169/16
2008/0035354 A1 2/2008 Cordani
2009/0224084 A1 * 9/2009 Hoisington ..... A01B 79/005 239/754
2012/0090862 A1 * 4/2012 Mahrt, Sr. ..... A62C 13/62 169/71
2012/0138319 A1 * 6/2012 Demmitt ..... A62C 3/025 169/28
2014/0202723 A1 * 7/2014 Cordani ..... A62C 13/66 169/62
2014/0209333 A1 * 7/2014 Cordani ..... A62C 31/24 169/70
2015/0096770 A1 * 4/2015 Cordani ..... A62C 3/16 169/54

* cited by examiner

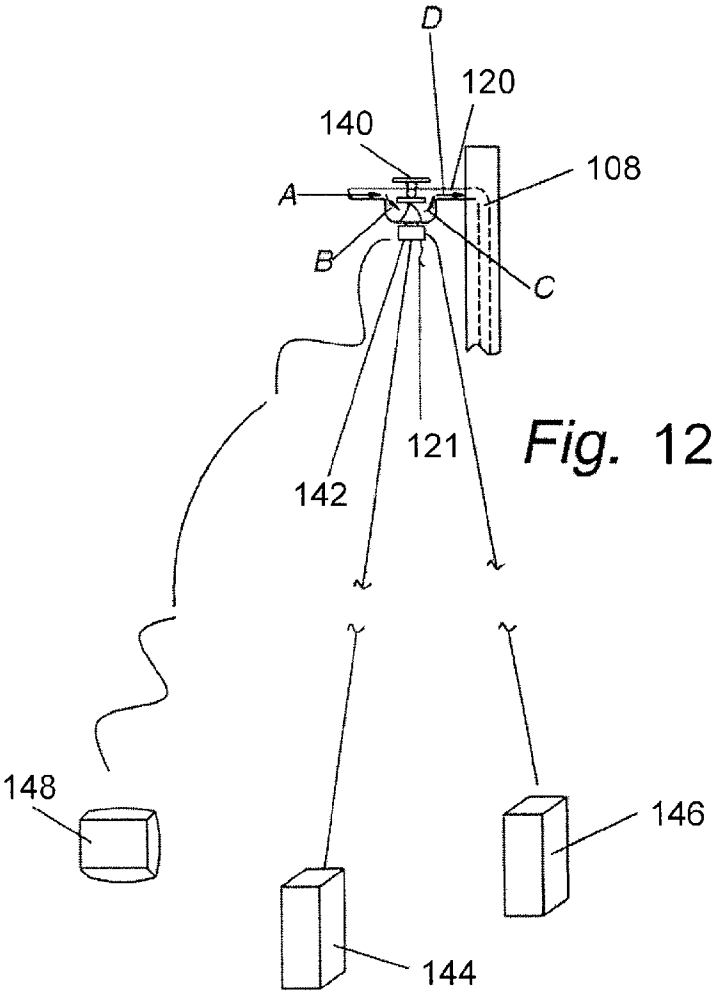
Fig. 12
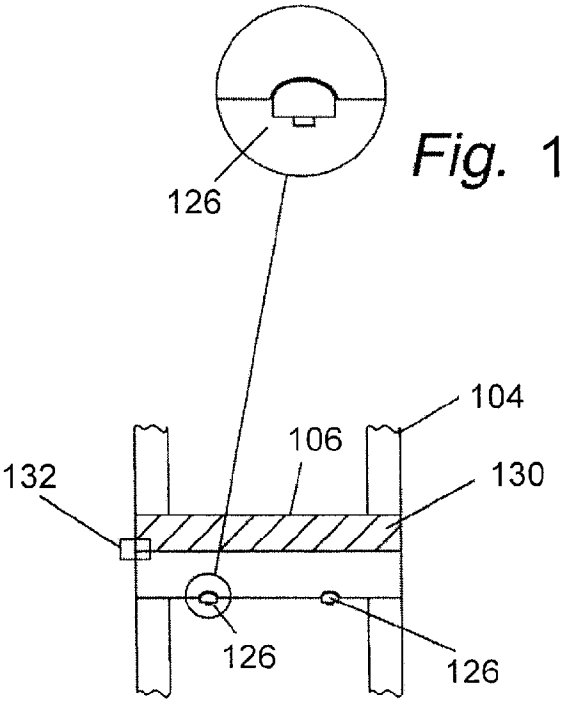
Fig. 11B
Fig. 11A

FLUID DISPENSING LADDER

PRIORITY CLAIM

In accordance with 37 CFR § 1.76, a claim of priority is included in an Application Data Sheet filed concurrently herewith. Accordingly, the present invention claims priority as a continuation-in-part of U.S. patent application Ser. No. 13/943,526, entitled "FLUID DISPENSING LADDER", filed Jul. 16, 2013, which claims the priority date of U.S. Provisional Patent Application No. 61/758,594, entitled "FLUID DISPENSING LADDER", filed Jan. 30, 2013. The contents of which the above referenced application is incorporated herein by reference.

FIELD OF THE INVENTION

This invention relates to the field of fire prevention, and more particularly to an improved ladder for dispersion of a fire suppressant or compositions thereof to shield an individual should a fire occur.

BACKGROUND OF THE INVENTION

In many cities the utilities are located beneath the surface of the earth, usually beneath the surface of the streets. These utilities are placed in tunnels or conduits. In the older cities, such as New York City, these utilities have been located in conduits for years or even decades. Over time the conduits which carry utilities may wear out and break. Further, electrical lines may simply be used beyond their use life as higher electrical loads are placed upon the lines. A serious problem is the failure of electrical transmission lines. These failures usually result in fires which must be quickly extinguished to prevent damage to the surrounding infrastructure.

While it is desirable to replace very old utilities in conduits and tunnels, it is not always practical. Due to financial restraints and other limitations, most of these electrical transmission lines have not been replaced. Unfortunately, failure of older electrical transmission lines can result in an electrical fire. These fires are commonly discovered when smoke is seen arising from manhole covers in the streets and sidewalks. It has been estimated by Consolidated Edison that there are approximately 40 electrical fires per day under the streets of New York City.

The cost of repairing and replacing the electrical transmission lines damaged by these fires is approximately $100,000.00 per linear foot of transmission line. Therefore, it is imperative that these fires be extinguished as quickly as possible. Inspection of lines can help pinpoint potential trouble areas. Unfortunately, inspection of the lines can trigger a fire. For instance, the opening of a manhole cover can provide the oxygen needed to support a fire. Similarly, a lineman performing an inspection may disturb a conduit resulting in arcing of electric lines, possibly triggering a fire.

Normally a lineman inspecting a potential problem area occurs while electrical power is still flowing through the lines. The inspection takes place within the manhole wherein a lineman inserts himself into the manhole. Typically a ladder is placed through the manhole and the lineman climbs down the ladder to permit inspection from within. Unfortunately the lineman can trigger a fire, or simply be in the wrong place at the wrong time. There have been many instances where a fire begins while the lineman is on the ladder. For instance, a fire may be smoldering as evidence by smoking coming out of the manhole. A lineman or fireman may then enter the manhole and, without notice, the smoldering may burst into an all encompassing fire. In many such instances, the individual who climbed into the manhole is now at risk of injury or death.

Another area of concern is the use of ladders for extracting of people from burning buildings. Firemen do not hesitate to lean a ladder against a building to reach the lower floors in an effort to fight fires or extract survivors. Unfortunately such a situation cannot predict if a fire will erupt from a lower floor and engulf the firefighter while he/she is on the ladder. While the firefighter is likely prepared for flash fire and is appropriately dressed, any survivor that they are pulling down the ladder will not be dressed should a fire approach the ladder area.

Thus, what is needed is an improved ladder that provides fire protection to the individual that climbs down the manhole for servicing of the electrical grid beneath the ground, or otherwise uses a ladder in an area where a fire may occur.

U.S. Pat. No. 6,834,728 discloses a system for extinguishing a fire in a tunnel. The system includes a conduit for delivering a fire extinguishing liquid and a trough extending parallel to the conduit for receiving liquid from the conduit. A carriage is arranged to move on a track which includes an upper edge of the trough. The carriage carries a pump having a nozzle, a video camera, and an inlet; each of which can be controlled robotically from a remote control station. The inlet is deployed in the trough to draw liquid from the trough.

U.S. Pat. No. 7,096,965 discloses a method of proportioning a foam concentrate into a non-flammable liquid to form a foam concentrate/liquid mixture and create a flowing stream of the foam concentrate/liquid mixture. Nitrogen is introduced into the stream of the foam/liquid mixture to initiate the formation of a nitrogen expanded foam fire suppressant. The flowing stream carrying the nitrogen expanded foam is dispensed, which completes the full expansion of the nitrogen expanded foam fire suppressant, into the confined area involved in the fire, thereby smothering the fire and substantially closing off contact between combustible material involved in the fire and the atmosphere. The apparatus of this invention is adapted for expanding and dispensing foam and includes a housing defining an interior through which extends a discharge line. The ends of the housing are closed about the ends of the discharge line, and the ends of the discharge line extend beyond the ends of the housing to define a connector at one end for receiving a stream of foam concentrate/liquid and at the opposite end to define the foam dispensing end of the apparatus. A portion of the discharge line in the housing defines an educator for the introduction of expanded gas into the stream of foam concentrate/liquid flowing through the discharge line.

U.S. Pat. No. 7,104,336 discloses a method and apparatus for proportioning a foam concentrate into a non-flammable liquid to form a foam concentrate/liquid mixture and create a flowing stream of the foam concentrate/liquid mixture similar to the method and apparatus of U.S. Pat. No. 7,096,965.

U.S. Pat. No. 7,124,834 discloses a method for extinguishing a fire in a space such as a tunnel. The method includes spraying a fire extinguishing medium into the space by spray heads. In a first stage of the method, the flow and temperature of the hot gases produced by the fire are influenced by spraying an extinguishing medium into the space, especially by creating in the space at least one curtain of extinguishing medium. At least some spray heads in the space are pre-activated into a state of readiness. In a second stage of the method, at least one spraying head is activated to produce a spray of extinguishing medium.

U.S. patent application Ser. No. 11/680,803 is entitled "Process for Fire Prevention and Extinguishing", the contents of which are incorporated herein by reference. In this application, a process for retarding or extinguishing conflagrations using a super absorbent polymer in water is disclosed. The reaction of the water with the polymer creates a gel-like substance with a viscosity that allows the mixture to be readily pumped through a standardized 2.5 gallon water based fire extinguisher, yet viscous enough to cover vertical and horizontal surfaces to act as a barrier to prevent fire from damaging such structures, minimizing the manpower needed to continuously soak these structures.

U.S. Pat. No. 7,169,843 discloses absorptive, cross-linked polymers which are based on partly neutralized, monoethylenically unsaturated monomers carrying acid groups, and with improved properties, which has a high gel bed permeability and high centrifuge retention capacity.

U.S. Pat. No. 5,989,446 discloses a water additive for use in fire extinguishing and prevention. The additive comprises a cross-linked water-swellable polymer in a water/oil emulsion. The polymer particles are dispersed in an oil emulsion wherein the polymer particles are contained within discrete water "droplets" within the oil. With the help of an emulsifier, the water "droplets" are dispersed relatively evenly throughout the water/oil emulsion. This allows the additive to be introduced to the water supply in a liquid form, such that it can be easily educted with standard firefighting equipment.

U.S. Pat. No. 5,190,110 discloses the fighting of fires or protection of objects from fire by applying water which comprises dispersing in the water particles of a cross-linked, water-insoluble, but highly water-swellable, acrylic acid derivative polymer in an amount insufficient to bring the viscosity above 100 mPa's. Advantageously, the particles are present in an amount such that, after swelling, the swollen particles hold 60 to 70% by weight of the total water; the polymer being a copolymer of an acrylic acid, the water containing silicic acid and/or a silicate as well as sodium, potassium or ammonium ions. The water is freely pumpable, but the swollen particles adhere to surfaces they contact rather than running off rapidly.

U.S. Pat. No. 5,849,210 discloses a method of preventing or retarding a combustible object from burning including the steps of mixing water with a super absorbent polymer ("SAP") to form one at least partially hydrated SAP, and applying the at least partially hydrated SAP to the combustible object, before or after combustion. In another embodiment, an article of manufacture includes a SAP that is prehydrated and is useful for preventing a combustible object from burning, or preventing penetration of extreme heat or fire to a firefighter or other animal.

U.S. Pat. No. 6,372,842 discloses methods of using an aqueous composition or dispersion containing a water-soluble or water-dispersible synthetic polymer, and compositions formed thereof. The aqueous composition or dispersion is added to agricultural spray, ink, deicing, latex paint, cleaner and fire-extinguishing chemical compositions, water-based hydraulic compositions, dust control compositions and so on, to impart properties including, but not limited to, aerosol control, shear stability, transfer efficiency, oil/water reduction, emollient performance, lubricity, thickening, and anti-wear capability, to the resultant composition formed thereof.

U.S. Pat. No. 5,087,513 discloses polybenzimidazole polymer/superabsorbent polymer particles. These articles are prepared by either mixing the super absorbent polymer particulates with the polybenzimidazole polymer solution during the formation of the polybenzimidazole article, or forming a composite of a polybenzimidazole film or fiber material layer with a super absorbent polymer particulate containing layer. These polybenzimidazole products absorb large amounts of fluid while retaining the flame retardancy and chemical unreactivity of conventional polybenzimidazole materials.

U.S. Pat. No. 4,978,460 discloses a particulate additive for water for fire fighting containing a strongly swelling water-insoluble high molecular weight polymer as gelatinizing agent, which comprises a water-soluble release agent which causes the particles of said gelatinizing agent not to swell, the particles of the gelatinizing agent being encased or dispersed in the release agent. Suitable release agents include polyethylene glycol, sugars, mannitol, etc. The gelatinizing agent may be a moderately cross-linked water-insoluble acrylic or methacrylic acid copolymer.

U.S. Pat. No. 5,519,088 discloses an aqueous gel comprising a polymer of (meth)acrylamide or particular (meth) acrylamide derivative(s), particulate metal oxide(s) and an aqueous medium, a process for producing said gel, and products utilizing said gel. This aqueous gel can be produced so as to have transparency, be highly elastic and fire resistant and can prevent the spreading of flames. The aqueous gel when produced transparent, becomes cloudy when heated or cooled and is useful for the shielding of heat rays or cold radiation.

SUMMARY OF THE INVENTION

A ladder having provisions for protecting an individual by suppressing a fire in manhole or in an area where a fire may occur, such as in firefighting situations. The ladder includes a kit for strategically positioning spray nozzles for use in distributing a fire suppressant or compositions thereof around the ladder in the event of a fire, including the encompassing of any individual. The ladder kit includes mounting plates for attaching a conduit and directional spray nozzles positioned along the rails. The mounting plates are constructed and arranged to be secured to the rails without compromising the structural integrity of the rails without affecting the Occupational Safety and Health Administration (OSHA) compliance granted to the ladder. The fire suppressant or compositions thereof can be manually discharged by operating the valve handle at the gel tank or by activating a solenoid, either manually or remotely by use of an electric solenoid triggered by an actuator or triggered by automatically by heat sensors positioned along the ladder. The ladder is preferably constructed from fire resistant and non-conductive materials.

In another embodiment, a ladder having provisions for protecting an individual by suppressing a fire in manhole or in an area where a fire may occur, such as in firefighting situations. The ladder includes strategically positioned spray nozzles for use in distributing a fire suppressant or compositions thereof for encompassing any individual on the ladder, and the area directly around the ladder. The ladder includes directional chamber for carrying a fire suppressant or compositions thereof and directional spray nozzles on the rungs. The step ladder is preferably constructed from fire resistant material and the ladder rungs having an anti-slip surface.

Accordingly, it is an objective of the instant invention to provide an improved ladder for use in areas that might be subject to flash fires.

It is a further objective of the instant invention to provide a multipurpose ladder having fire suppression capabilities.

It is yet another objective of the instant invention to provide a ladder for protecting personnel from an electrical fire by providing a means for creating a non-conductive protective barrier around the ladder in the event of a fire.

It is a still further objective of the invention to modify a ladder that is OSHA compliant, and maintain that compliance by use of nondestructive fasteners for use in attaching the fire suppression device.

It is a further objective of the present invention to provide a ladder having strategically positioned spray nozzles and a volume of fire suppression material calculated to provide the individual time to extract themselves from the manhole.

It is still a further objective of the present invention to provide an individual a means to activate the system from any point on the ladder.

Accordingly, it is an objective of the present invention to provide an improved ladder for use in areas that might be subject to flash fires.

It is another objective of the present invention to provide a multipurpose ladder having fire suppression capabilities.

It is a further objective of the present invention to provide a ladder for protecting of personnel by providing a means for suppressing of an electrical fire.

It is a further objective of the present invention to provide a ladder wherein fire suppressing material can be manually triggered by an individual working on ladder, or by another person remote from the ladder, or automatically.

It is a further objective of the present invention to provide a ladder employing a battery operated solenoid valve for control of the fire suppressing material, which can be manually, remotely by electric trigger or RF transmitter, or automatically operated by use of temperature activated sensors or nozzles.

It is a further objective of the present invention to provide a ladder constructed from fire resistant materials that are not electrically conductive.

It is yet another objective of the present invention to provide a ladder have strategically positioned spray nozzles for coating the individual and calculated to provide the individual time to extract themselves from the manhole.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof

BRIEF DESCRIPTION OF THE FIGURES

FIG. 11A is an enlarged view of a safety ladder rung;

FIG. 11B is an enlarged side view of a mounted nozzle; and

FIG. 12 is a pictorial view of a solenoid with various activators.

DETAILED DESCRIPTION OF THE INVENTION

Figure 1:
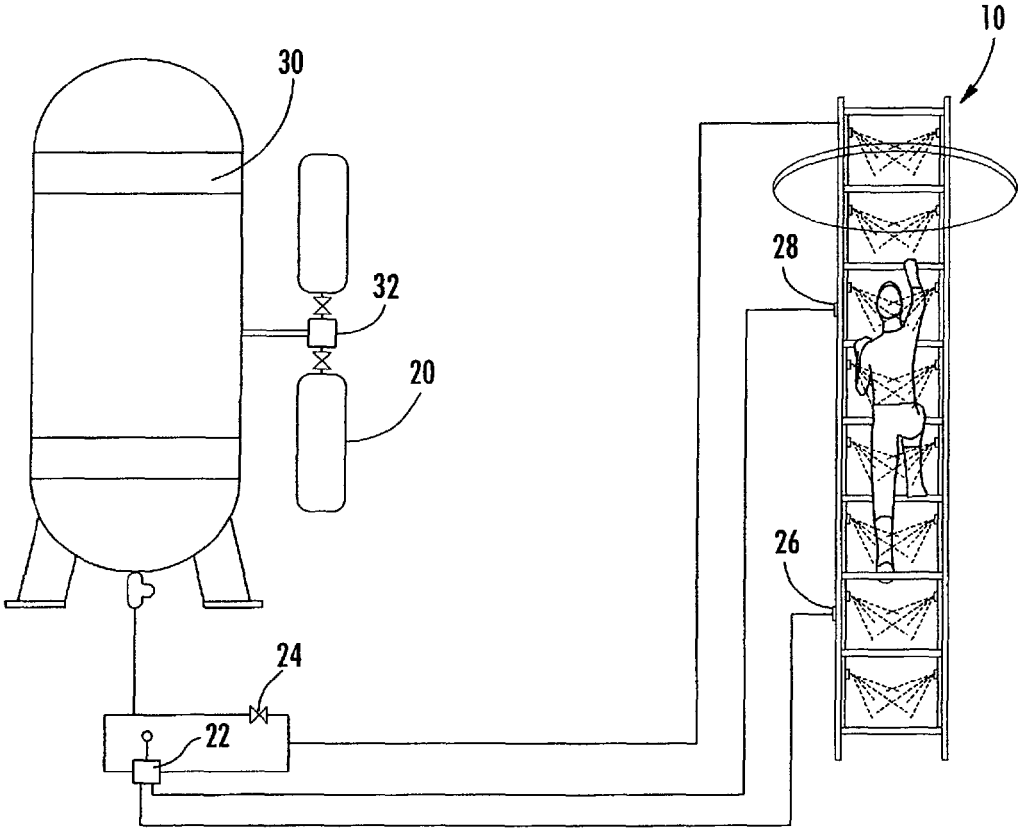
FIG. 1 is a pictorial view of the present invention.
Figure 2:
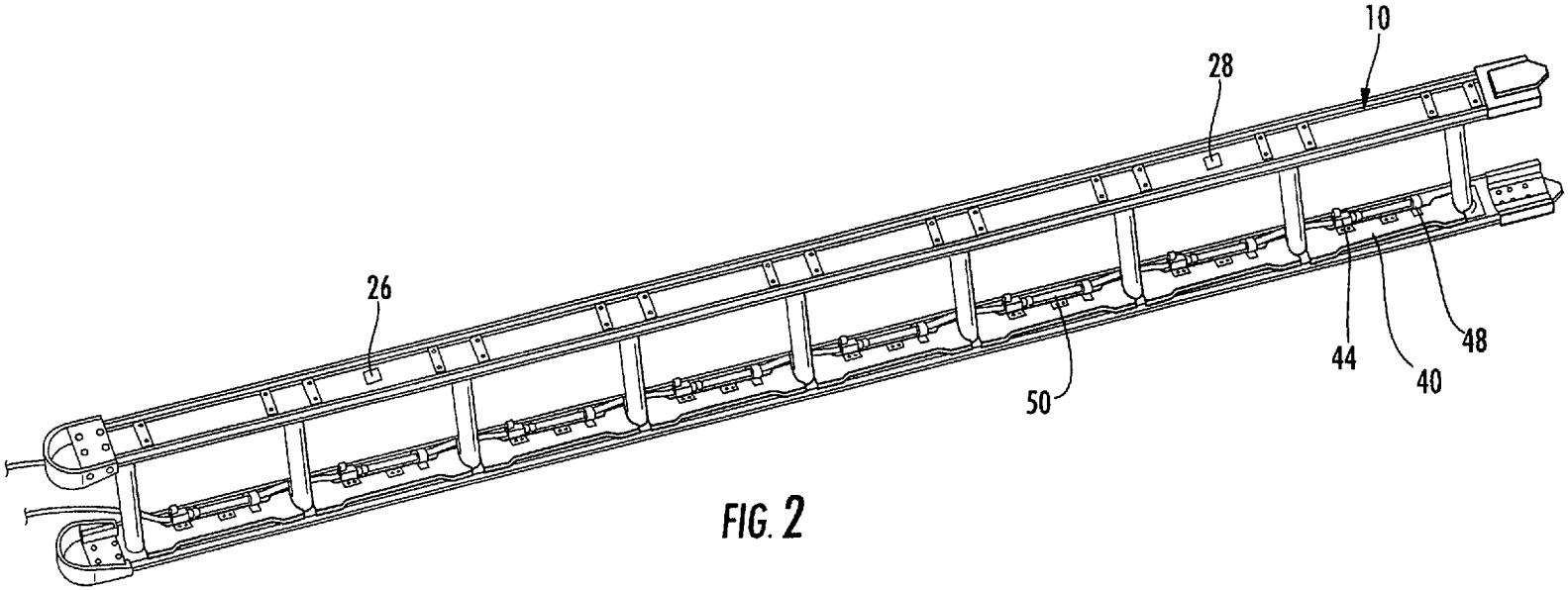
FIG. 2 is a side perspective view of the fluid dispensing kit installed on a ladder.
Figure 3:
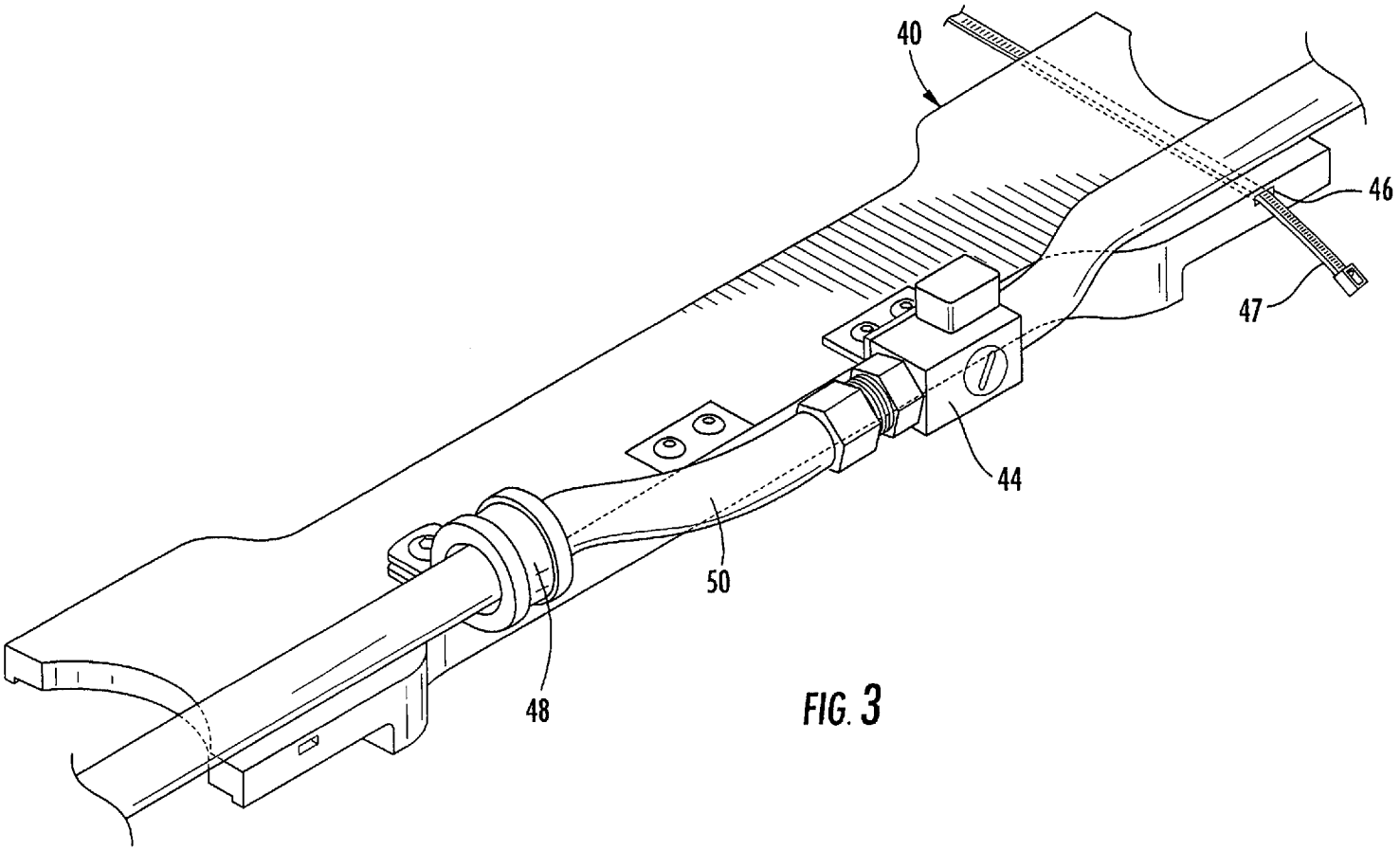
FIG. 3 is a top perspective view of the mounting plate.
Figures 4A, 4B:
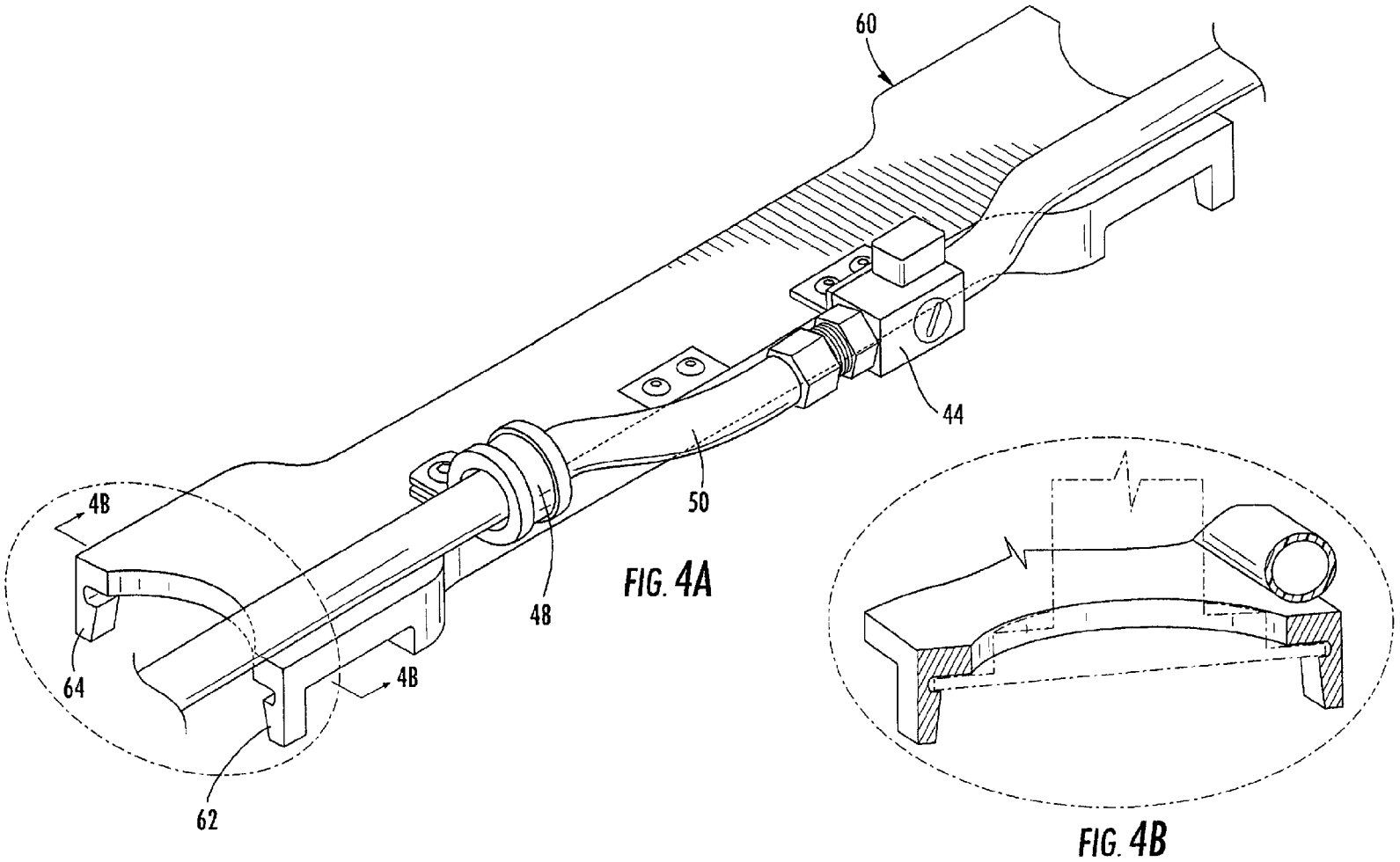
FIG. 4A is a top perspective view of an alternate embodiment of the mounting plate.
FIG. 4B is a front perspective view as viewed along line 4B-4B of FIG. 4A.
Figure 5A:
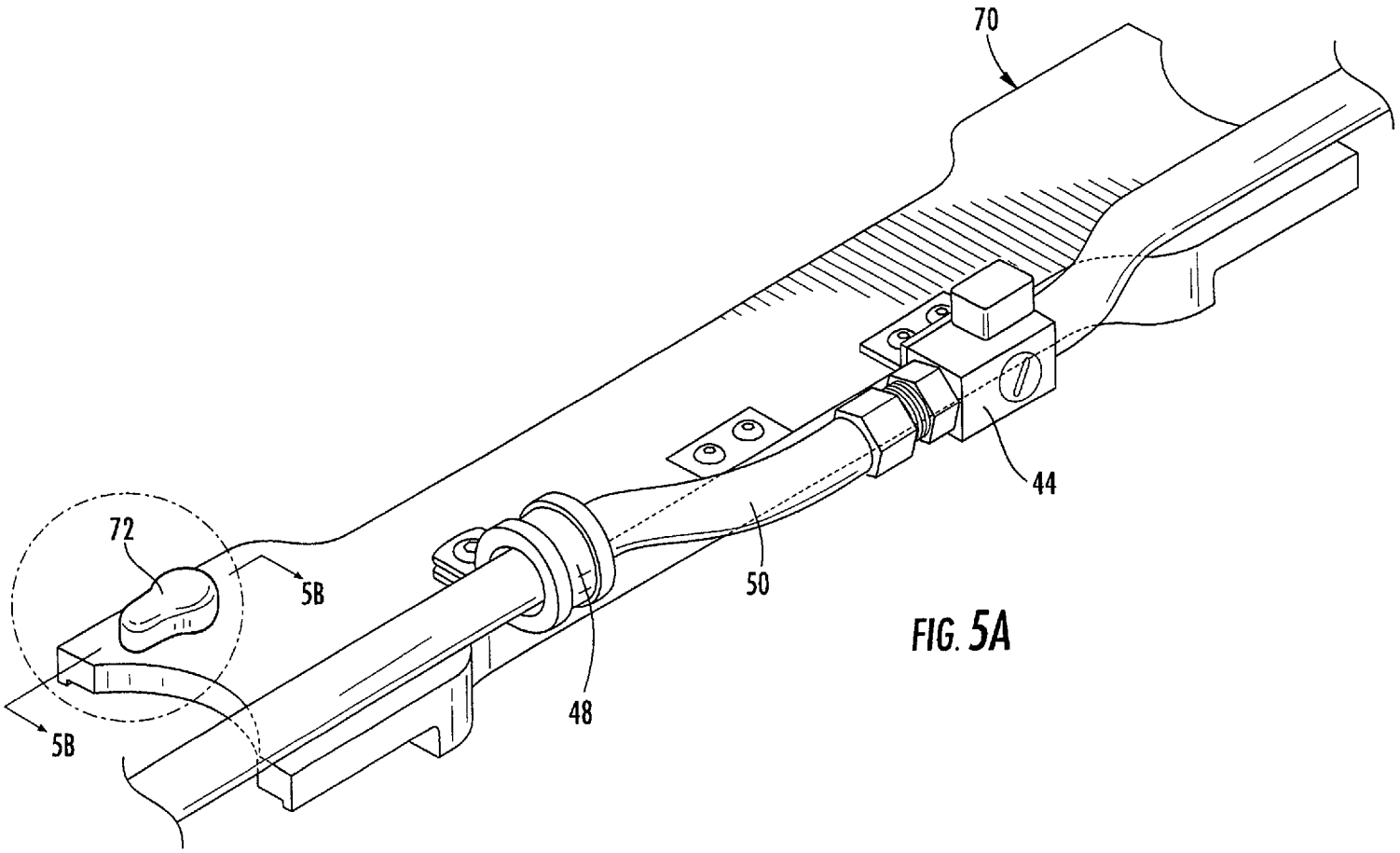
FIG. 5A is a top perspective view of an alternate embodiment of the mounting plate.
Figure 5B:
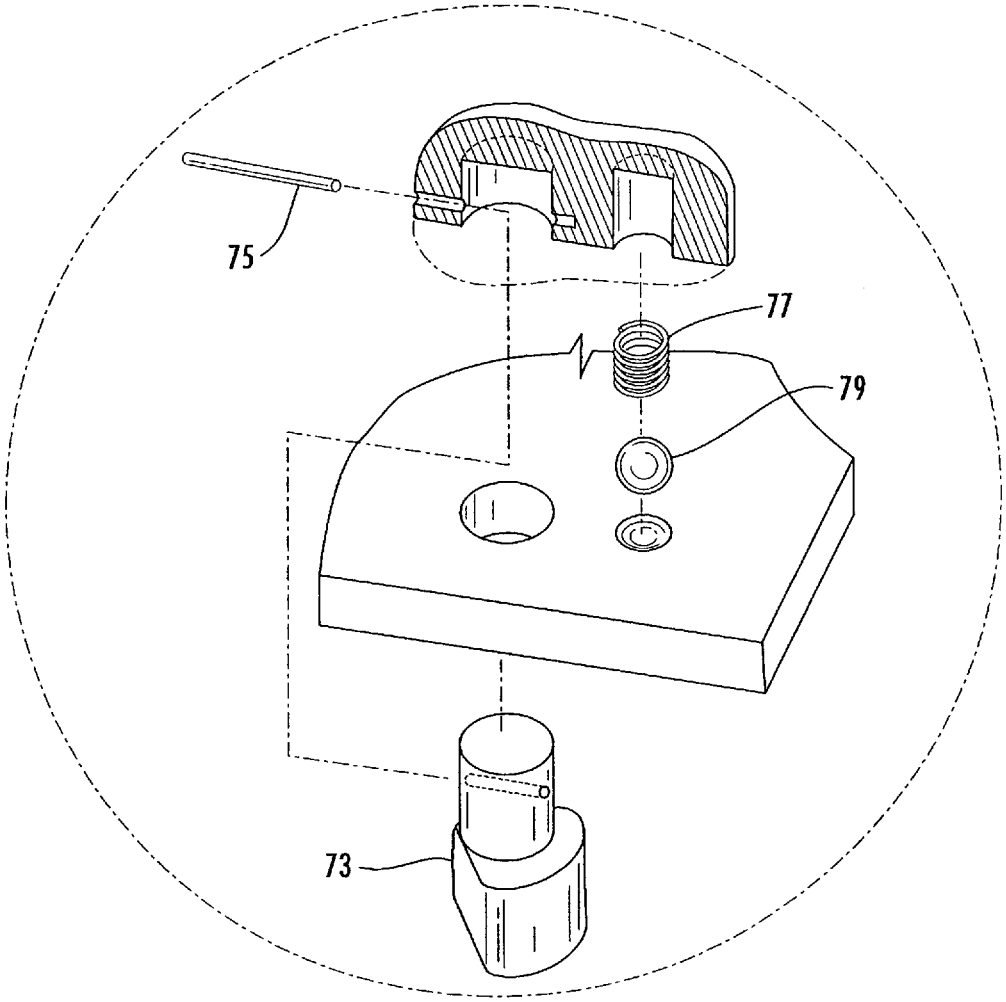
FIG. 5B is an exploded cross sectional view as viewed along line 5B-5B of FIG. 5A.
Figure 6:
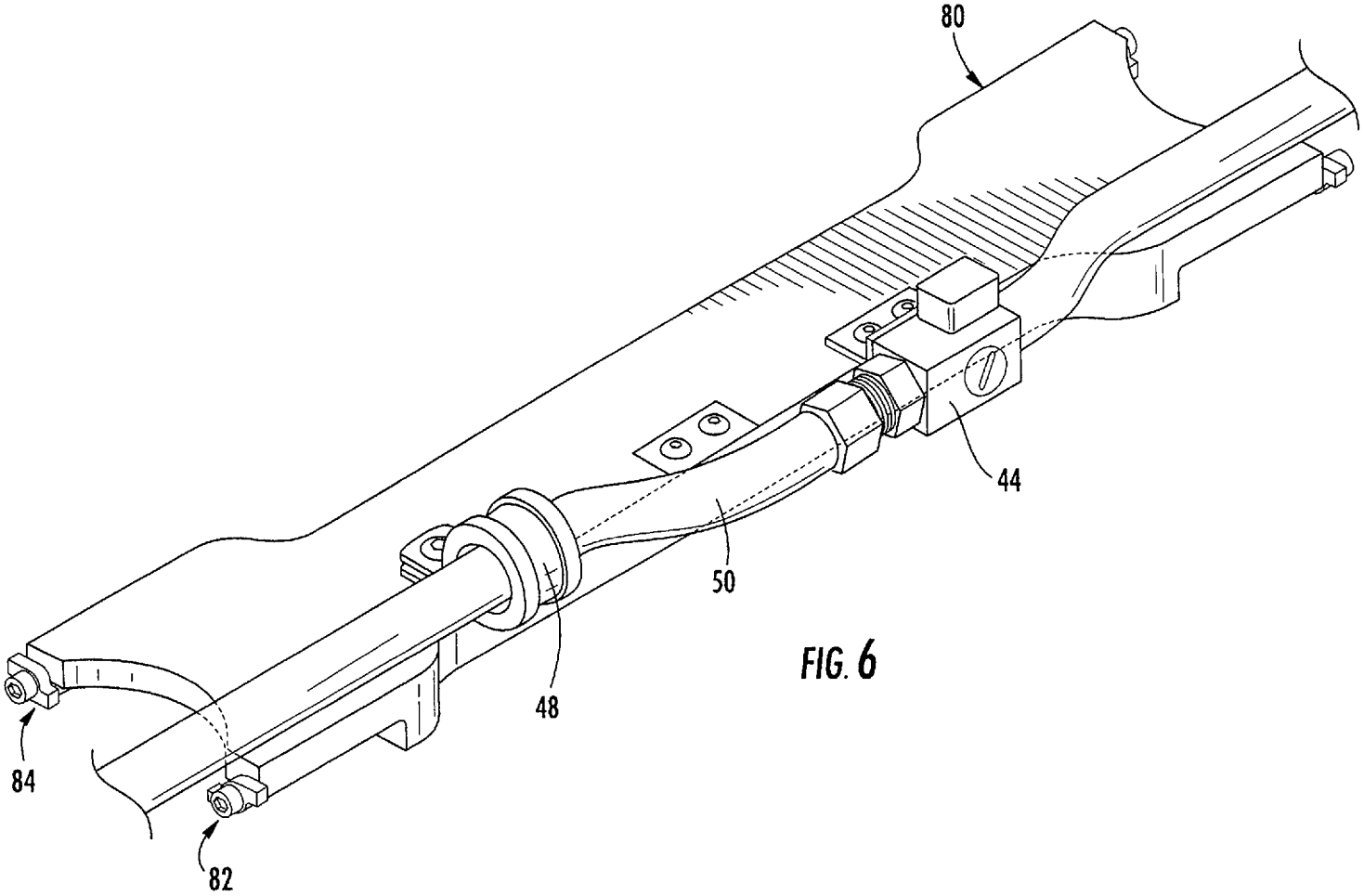
FIG. 6 is a top perspective view of an alternate embodiment of the mounting plate.
Figure 7:
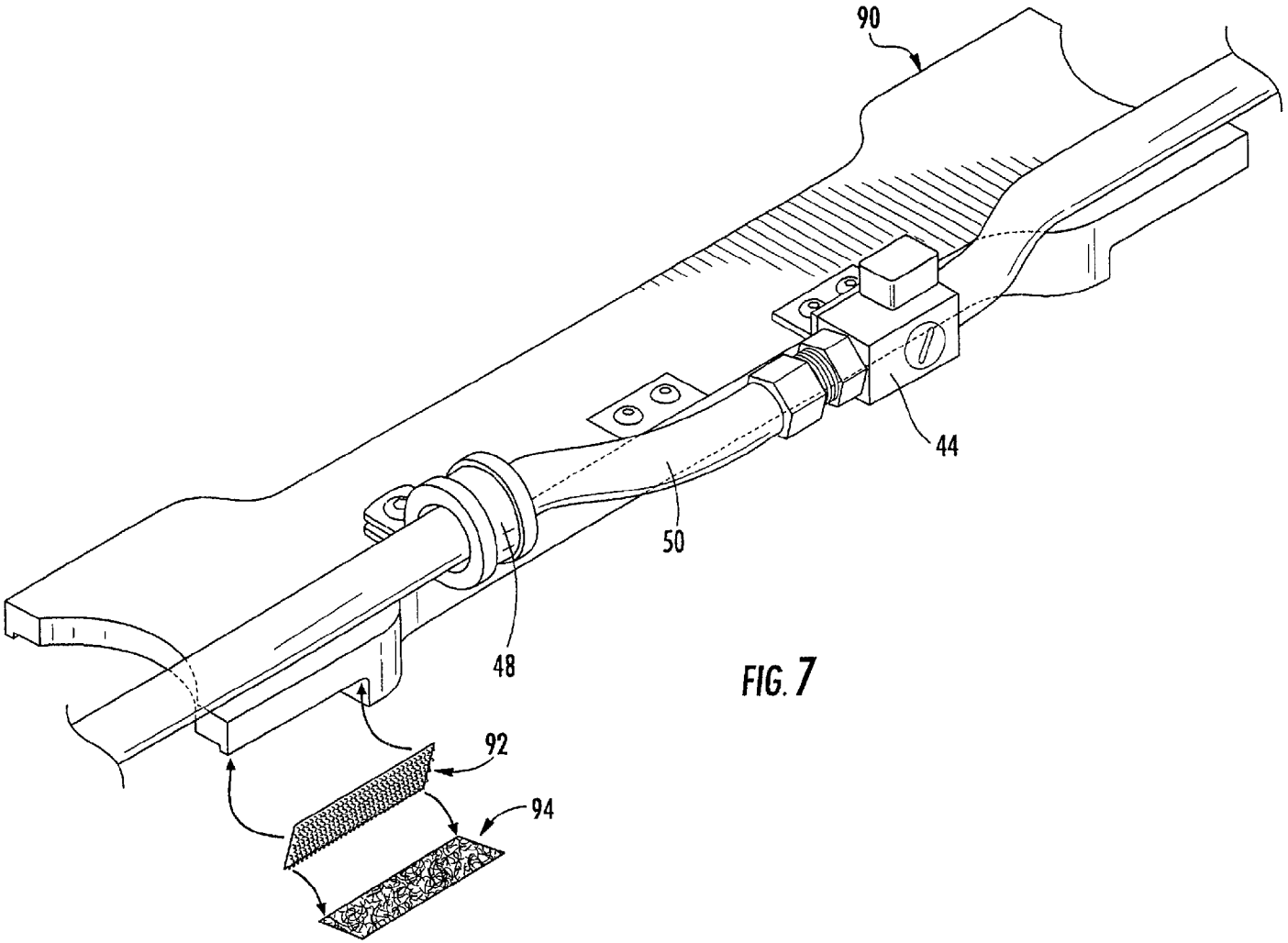
FIG. 7 is a top perspective view of an alternate embodiment of the mounting plate.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

The present invention relates to a unique technique for suppressing fires. This unique technique utilizes a fire suppressant in an amount sufficient to suppress or extinguish an electrical fire. The present invention utilizes one or more fire suppressant compositions. The fire suppressant compositions can be any known fire suppressants, including biodegradable, super absorbent, aqueous based polymers. Examples of these polymers are cross-linked modified polyacrylamides/potassium acrylate or polyacrylamides/sodium acrylate. Other suitable polymers include, albeit not limited to, carboxy-methylcellulose, alginic acid, cross-linked starches, and cross-linked polyaminoacids. Know fire suppressants marketed under the brand name of FIREICE, CEMDAL AQUA SHIELD, BARRICADE, THERMO-GEL, WILDFIRE AFG FIREWALL, BIOCENTRAL BLAZETAMMER, PHOS-CHEK INSUUL, and THERMO GEL. As used herein, a "fire suppressant" composition is meant to be inclusive of all components of the composition. In some embodiments, the fire suppressant composition comprises one or more fire suppressant compounds. In other embodiments, the fire suppressant composition comprises one or more common components of fire suppressant formulations, such as: fire suppressant salts, conventional fire suppressants, corrosion inhibitors, spoilage inhibitors, foaming agents, non foaming agents, flow conditioners, stability additives, thickening agents, conventional fire suppressants, pigments, dyes or the like. In some embodiments, the fire suppressant or compositions thereof is in dry form. In other embodiments, the fire suppressant or compositions thereof are hydrated. The fire suppressant or compositions thereof can be a liquid, foam, or semi-liquid form, such as, for example, gel having varying viscosities.

In some embodiments, a conventional fire suppressant comprises penta-bromodiphenyl ether, octa-bromodiphenyl ether, deca-bromodiphenyl ether, short-chain chlorinated paraffins (SCCPs), medium-chain chlorinated paraffins (MCCPs), hexabromocyclododecane (HBCD), tetrabromobisphenol A (TBBPA), tetrabromobisphenol A ether, pentabromotoluene, 2,3-dibromopropyl-2,4,6-tribromophenyl ether, tetrabromobisphenol A, bis(2,3-dibromopropyl ether), tris(tribromophenoxy)triazine, tris(2-chloroethyl)phosphate (TCEP), tris(2-chloro-1-methylethyl)phosphate (TCPP or TMCP), tris (1,2-dichloropropyl)phosphate (TDCP), 2,2-bis (chloromethyl)-trimethylene bis(bis(2-chloroethyl)phosphate), melamine cyanurate, antimony trioxide $Sb_2O_3$ (ATO), boric acid, ammonium polyphosphate (APP), aluminum ammonium polyphosphate, aluminum hydroxide, magnesium hydroxide red phosphorous, 1,2-bis(tribromophenoxy)ethane, 2,4,6-tribromophenyl glycidyl ether, tetrabromo phthalic anhydride, 1,2-bis(tetrabromo phthalimide) ethane, tetrabromo dimethyl phthalate, tetrabromo disodium phthalate, decabromodiphenyl ether, tetradecabromodi(phenoxyl)benzene, 1,2-bis(pentabromophenyl)ethane, bromo-trimethyl-phenyl-hydroindene, pentabromobenzyl acrylate, pentabromobenzyl bromide, hexabromobenzene, pentabromotoluene, 2,4,6-tribromophenyl maleimide, hexabromo cyclododecane, N,N'-1,2-bis(dibromonorbornyl dicarbimide) ethane, pentabromochloro-cyclohexane, tri(2,3-dibromopropyl)isocyanurate, bromo-styrene copolymer, tetrabromobisphenol A-carbonate oligomer, polypentabromobenzyl acrylate, polydibromophenylene ether; chlorinated flame retardants such as: dechlorane plus, HET anhydride (chlorendic anhydride), perchloro pentacyclodecane, tetrachloro bisphenol A, tetrachlorophthalic anhydride, hexachlorobenzene, chlorinated polypropylene, chlorinated polyvinyl chloride, vinyl chloride-vinylidene chloride copolymer, chlorinated polyether, hexachloroethane; organic phosphorus flame retardants such as: 1-oxo-4-hydroxymethyl-2,6,7-trioxa-1-phosphabicyclo [2,2,2]octane, 2,2-dimethyl-1,3-propanediol-di(neopentyl glycol)diphosphate, 9,10-dihydro-9-oxa-10-phosphaphenanthrene-10 oxide, bis(4-carboxyphenyl)-phenyl phosphine oxide, bis(4-hydroxyphenyl)-phenyl phosphine oxide, phenyl(diphenyl sulfone) phosphate oligomer; phosphorus-halogenated flame retardants such as tris(2,2-di(bromomethyl)-3-bromopropyl) phosphate, tris(dibromophenyl)phosphate, 3,9-bis(tribromophenoxy)-2,4,8,0-tetraoxa-3,9-diphosphaspiro[5,5]-3,9-di-oxo-undecane, 3,9-bis(pentabromophenoxy)-2,4,8,10-tetraoxa-3,9-diphosphaspiro[5,5]-3,9-dioxo-undecane, 1-oxo-4-tribromophenoxycarbonyl-2,6,7-trioxa-1-phosphabicyclo[2,2,2]octane, p-phenylene-tetrakis(2,4,6-tribromophenyl)-diphosphate, 2,2-di(chloromethyl)-1,3-propanediol-di(neopentyl glycol)diphosphate, 2,9-di(tribromoneopentyloxy)-2,4,8,10-tetraoxa-3,9-diphosphaspiro[5,5]-3-, 9-dioxo-undecane; nitrogen-based flame retardants or phosphorus-nitrogen-based flame retardants such as melamine, melamine cyanurate, melamine orthophosphate, dimelamine orthophosphate, melamine polyphosphate, melamine borate, melamine octamolybdate, cyanuric acid, tris(hydroxyethyl)isocyanurate, 2,4-diamino-6-(3,3,3-trichloro-propyl)-1,3,5-triazine, 2,4-di(N-hydroxymethyl-amino)-6-(3,3,3-trichloro-propyl-1,3,5-triazine), diguanidine hydrophosphate, guanidine dihydrogen phosphate, guanidine carbonate, guanidine sulfamate, urea, urea dihydrogen phosphate, dicyandiamide, melamine bis(2,6,7-trioxa-phospha-bicyclo[2.2.2]octane-1-oxo-4-methyl)-hydroxy-phosphate, 3,9-dihydroxy-3,9-dioxo-2,4,8,10-tetraoxa-3,9-diphosphaspiro[5,5]u-ndecane-3,9-dimelamine,1,2-di(2-oxo-5,5-dimethyl-1,3-dioxa-2-phosphacyclohexyl-2-amino) ethane, N,N'-bis(2-oxo-5,5-dimethyl-1,3-dioxa-2-phosphacyclohexyl)-2,2'-m-phenylenediamine, tri(2-oxo-5,5-dimethyl-1,3-dioxa-2-phosphacyclohexyl-2-methyl)amine, hexachlorocyclotriphosphazene; and inorganic flame retardants such as: red phosphorus, ammonium polyphosphate, diammonium hydrophosphate, ammonium dihydrogen phosphate, zinc phosphate, aluminum phosphate, boron phosphate, antimony trioxide, aluminum hydroxide, magnesium hydroxide, hydromagnesite, alkaline aluminum oxalate, zinc borate, barium metaborate, zinc oxide, zinc sulfide, zinc sulfate heptahydrate, aluminum borate whisker, ammonium octamolybdate, ammonium heptamolybdate, zinc stannate, stannous oxide, stannic oxide, ferrocenc, ferric acetone, ferric oxide, ferro-ferric oxide, ammonium bromide, sodium tungstate, potassium hexafluorotitanate, potassium hexafluorozirconate, titanium dioxide, calcium carbonate, barium sulfate, sodium bicarbonate, potassium bicarbonate, cobalt carbonate, zinc carbonate, basic zinc carbonate, heavy magnesium carbonate, basic magnesium carbonate, manganese carbonate, ferrous carbonate, strontium carbonate, sodium potassium carbonate hexahydrate, magnesium carbonate, calcium carbonate, dolomite, basic copper carbonate, zirconium carbonate, beryllium carbonate, sodium sesquicarbonate, cerium carbonate, lanthanum carbonate, guanidine carbonate, lithium carbonate, scandium carbonate, vanadium carbonate, chromium carbonate, nickel carbonate, yttrium carbonate, silver carbonate, praseodymium carbonate, neodymium carbonate, samarium carbonate, europium carbonate, gadolinium carbonate, terbium carbonate, dysprosium carbonate, holmium carbonate, erbium carbonate, thulium carbonate, ytterbium carbonate, lutetium carbonate, aluminum diacetate, calcium acetate, sodium bitartrate, sodium acetate, potassium acetate, zinc acetate, strontium acetate, nickel acetate, copper acetate, sodium oxalate, potassium oxalate, ammonium oxalate, nickel oxalate, manganese oxalate dihydrate, iron nitride, sodium nitrate, magnesium nitrate, potassium nitrate, zirconium nitrate, calcium dihydrogen phosphate, sodium dihydrogen phosphate, sodium dihydrogen phosphate dihydrate, potassium dihydrogen phosphate, aluminum dihydrogen phosphate, ammonium dihydrogen phosphate, zinc dihydrogen phosphate, manganese dihydrogen phosphate, magnesium dihydrogen phosphate, disodium hydrogen phosphate, diammonium hydrogen phosphate, calcium hydrogen phosphate, magnesium hydrogen phosphate, ammonium phosphate, magnesium ammonium phosphate, ammonium polyphosphate, potassium metaphosphate, potassium tripolyphosphate, sodium trimetaphosphate, ammonium hypophosphite, ammonium dihydrogen phosphite, manganese phosphate, dizinc hydrogen phosphate, dimanganese hydrogen phosphate, guanidine phosphate, melamine phosphate, urea phosphate, strontium dimetaborate hydrogen phosphate, boric acid, ammonium pentaborate, potassium tetraborate octahydrate, magnesium metaborate octahydrate, ammonium tetraborate tetrahydrate, strontium metaborate, strontium tetraborate, strontium tetraborate tetrahydrate, sodium tetraborate decahydrate, manganese borate, zinc borate, ammonium fluoroborate, ammonium ferrous sulfate, aluminum sulfate, potassium aluminum sulfate, ammonium aluminum sulfate, ammonium sulfate, magnesium hydrogen sulfate, aluminum hydroxide, magnesium hydroxide, iron hydroxide, cobalt hydroxide, bismuth hydroxide, strontium hydroxide, cerium hydroxide, lanthanum hydroxide, molybdenum hydroxide, ammonium molybdate, zinc stannate, magnesium trisilicate, telluric acid, manganese tungstate, manganite, cobaltocene, 5-aminotetrazole, guanidine nitrate, azobisformamide, nylon powder, oxamide, biuret, pentaerythritol, decabromodiphenyl ether, tetrabromophthalic anhydride, dibromoneopentyl glycol, potassium citrate, sodium citrate, manganese citrate, magnesium citrate, copper citrate, ammonium citrate, nitroguanidine.

Referring to FIGS. 1 to 7, the present invention is a fluid dispensing kit for installation on a ladder 10 which can be used to protect personnel that are within a manhole or otherwise in a position where a flash fire may occur. Electrical fires present different and unique problems pertaining to how these fires should be suppressed. Water is normally used to fight fires because it can quickly cool down the burning material. However, water and electricity are harmful, if not deadly to individuals, when brought into contact with each other. Normally, when water hits an active electrical circuit, it shorts out the circuit which usually results in destruction of the circuit. Further, when individuals are in close proximity to the water contacting the electricity, there is a strong likelihood that the water will act as a conductor and conduct the electricity to the individuals, resulting in serious injury or death of the individuals. Since water spreads rapidly in all directions on surfaces, electricity which comes in contact with the water will be conducted to wherever the water flows. Because it is difficult to prevent water from flowing to certain areas, there is a strong likelihood that individuals will be injured or killed when they come in contact with this water. Metal ladders provide an excellent conductor and, despite the resistance to fire, should not be used where live electrical wires exist.

In the preferred embodiment of the present invention, a fire suppressant is utilized. Various fire suppressants can be used, including those having a gel form which can remain within a confined area because of their relatively high viscosity. The present invention adds a predetermined amount of a fire suppressant, if it is in a dry form for example, to a predetermined amount of water to obtain an admixture which has properties that enable the admixture to suppress the spread of an electrical fire and extinguish any fire that has attached itself to the individual. The fire suppressant can be added to a given volume of water and the resulting admixture pumped to a location to suppress the spread of and extinguish electrical fires. The adherence of the admixture of fire suppressant or compositions thereof and water to the clothing of the individual lowers the temperature of the clothing below a combustion temperature thereby giving the individual time to exit the manhole.

Currently, firefighters apply water to the electrical conduits/components which are on fire and also to adjacent conduits/components. Because it is difficult to control where the water goes, the contact of water on electrical conduits/components which are not on fire results in substantial unnecessary damage to these conduits/components. The present invention, on the other hand, enables a controlled dispersion of a fire suppressant or compositions thereof to a specific area for the primary purpose of protecting the individual from the fire, and giving the individual time to escape the manhole. The fire suppressant adheres to the individual and the ladder, without affecting adjacent conduits/components. Thus, a substantial safety factor is gained because electrical conduits/components are not sprayed and, if they are sprayed, the admixture is not conductive like water.

Referring now to the Figures, disclosed is a ladder 10 comprised of a pair of spaced parallel rails coupled together by a plurality of spaced apart transverse rungs. The rails include an inner and an outer surface and at least one of the inner and outer surfaces include a channel extending along the length thereof.

The invention is a fluid dispensing kit constructed and arranged to provide fire suppression and personal protection for an individual on the ladder. The kit is comprised of at least one mounting plate 40 with a means for securing the mounting plate to the channel positioned in between the rungs.

In order to comply with the Occupational Safety and Health Administration (OSHA) standards, the structural integrity of the rails cannot be compromised. In a preferred embodiment, the means for securing the mounting plate 40 includes a flow through aperture 46 constructed and arranged to cooperate with a zip tie 47 to secure the mounting plate 40 to the rungs. In an alternative embodiment 60, the means for securing the mounting plate includes clips 62, 64 having a substantially conjugate shape as the rungs constructed and arranged to interlock with the rungs. The means for securing the mounting plate include but are not limited to a ball detent capture mechanism 77, 79, a cam clamp mechanism 73, 75, a torsion spring mechanism 82, 84, a hook and loop mechanism 92, 94, a bonding material, resistance welding straps, and adhesive tape.

In a preferred embodiment, the mounting plate 40 is constructed of an ultra-high molecular weight plastic and is integrally formed. However, any suitable non-conductive material can be utilized and not deviate from the scope of the invention.

A plurality of spray nozzles are secured to the mounting plates and fluidly coupled to the fluid conduit. The nozzles 44 are positioned to create overlapping spray patterns so that the entire ladder is covered with the spray containing the fire suppressant or compositions thereof to protect someone ascending the ladder during a fire.

There is at least one fluid conduit 50 that extends along the length of one of the channels is secured by at least one clamp 48. The clamp 48 is fixedly attached to the mounting plate 40. In a preferred embodiment, a fluid conduit 50 extends along the length of each of the channels and is secured by a plurality of clamps 48. The plurality of clamps 48 are fixedly attached to a plurality of mounting plates 40. The fluid conduit 50 is comprised of a non-conductive material.

The system includes at least one container 30 having a predetermined amount of a fire suppressant or compositions thereof The container has an outlet that includes at least one valve positioned in the line. In a preferred embodiment, the container 30 outlet line comprises a solenoid valve and a manually operated bypass valve. The outlet of the container is fluidly coupled to the fluid conduit 50. In a preferred embodiment, the container is coupled to the conduit with a hose that cooperates with a quick connect device.

There is at least one valve positioned in the discharge side of the container, this is a solenoid 22 operated by a push button 26 positioned on the ladder 10 electrically coupled to the solenoid 22, whereby a person can discharge the fire suppressant or compositions thereof from the ladder. The solenoid 22 can also be operated by a heat sensor 28 positioned on the ladder electrically coupled to the solenoid 22. The sensor 28 is positioned to sense the heat from the arc flash in the case of an electrical fire. In a preferred embodiment, the heat sensor 28 is a fixed temperature detector with no thermal lag.

The discharge side of the container 30 also has a manually operated bypass valve 24 that can be operated by an individual that is not on the ladder. In a preferred embodiment, the manually operated bypass valve 24 is spring operated mechanism that fails closed. This is to insure that the container 30 is not accidentally discharged as the bypass valve requires an operator to hold it open.

At least one propellant tank 20 having a predetermined amount of compressed gas is coupled to the container with a gas conduit. A valve is positioned in the gas conduit between the propellant tank 20 and the container 30. The valve is manually operable to allow gas to charge the fire suppressant or compositions thereof in order to be delivered to the plurality of spray nozzles 44. In a preferred embodiment, the container 30 is always charged with compressed gas.

A regulator 32 is positioned in the gas conduit to allow the gas to flow at a predetermined pressure. In a preferred embodiment, the gas is supplied at a predetermined pressure and volume to allow a fire suppressant or compositions thereof to discharge at a rate to provide coverage in with the spray pattern for a time sufficient for someone to ascend the ladder in case of a fire. It is contemplated that two minutes of discharge of the a fire suppressant or compositions thereof would be sufficient however a longer or shorter duration could be utilized without deviating from the scope of the invention.

In another embodiment, a ladder assembly formed from a pair of rails constructed from a non-conductive material having an inner and an outer surface and each rail having a channel portion spaced apart and extending longitudinally along the inner surface to receive a plurality of transverse rungs extending between the inner surfaces of opposing rail channels. Mounting plates are constructed and arranged to fit in the channel and between adjacent rungs along the inner surface of said rails. In some embodiments, a conduit extends along the length of the rail and is secured to the mounting plates. In some embodiments, at least one spray nozzle is fluidly coupled to the conduit.

In some embodiments, the ladder assembly comprises a storage container coupled to the conduit. In some embodiments, the storage container holds a predetermined amount of a fire suppressant or compositions thereof. The fire suppressant may be in a dry form and hydrated as needed or is maintained in a hydrated form.

In another embodiment, a solid form of a fire suppressant or compositions thereof, such as a powder, is added to a stream or body of water which results in an aqueous admixture of the fire suppressant or compositions thereof and water having properties which enable the fire suppressant or compositions thereof and water admixture when applied over the individual to remain within the confined area because of its relatively high viscosity. The properties of the admixture, in particular its viscosity, also enable the admixture to be applied to remain on vertical, horizontal, and curved surfaces of the ladder used by the individual to enter the manhole or other situations where a fire may occur. The present invention adds a predetermined amount of the fire suppressant or compositions thereof to a predetermined amount of water to obtain an admixture which has properties that enable the admixture to suppress the spread of an electrical fire and extinguish any fire that has attached itself to the individual. The adherence of the admixture of a fire suppressant or compositions thereof and water to the clothing of the individual lowers the temperature of the clothing below a combustion temperature thereby giving the individual time to exit the manhole. In addition, adherence of the admixture of a fire suppressant or compositions thereof and water to the clothing maintains moisture content at a level which suppresses the spread of the fire by preventing combustion of the clothing from hot embers and/or flames. Further, placing the admixture upon exposed skin deters burning of the skin.

Referring now to FIGS. 8 to 12, set forth is a ladder 10 of the instant invention which consists of the first strut 102 and the second strut 104 with a plurality of rungs 106 which are spaced apart and mounted to the first strut 102 and second strut 104. In this embodiment strut 102 includes a chamber for placement of a fluid conduit 108 which is fluidly coupled to at least one of the rungs 106. The fluid conduit 108 has an inlet along solenoid 120 which is coupled to a container 101 positioned a distance from the ladder and coupled thereto by a flexible hose 103. Rung 106 includes at least one nozzle 126 which is fluidly coupled to the fluid conduit 108. The fluid conduit 108 may consist of an inlaid tube or pipe, or utilize an open chamber within the strut. The illustration of FIG. 8 includes a manhole 105 which provides access to utilities in an underground tunnel or conduit, not shown. These utilities can be electrical cables, telephone lines, water supply lines, and so forth. The manhole 105 permits individuals to gain access to the underground tunnel.

Figure 8:
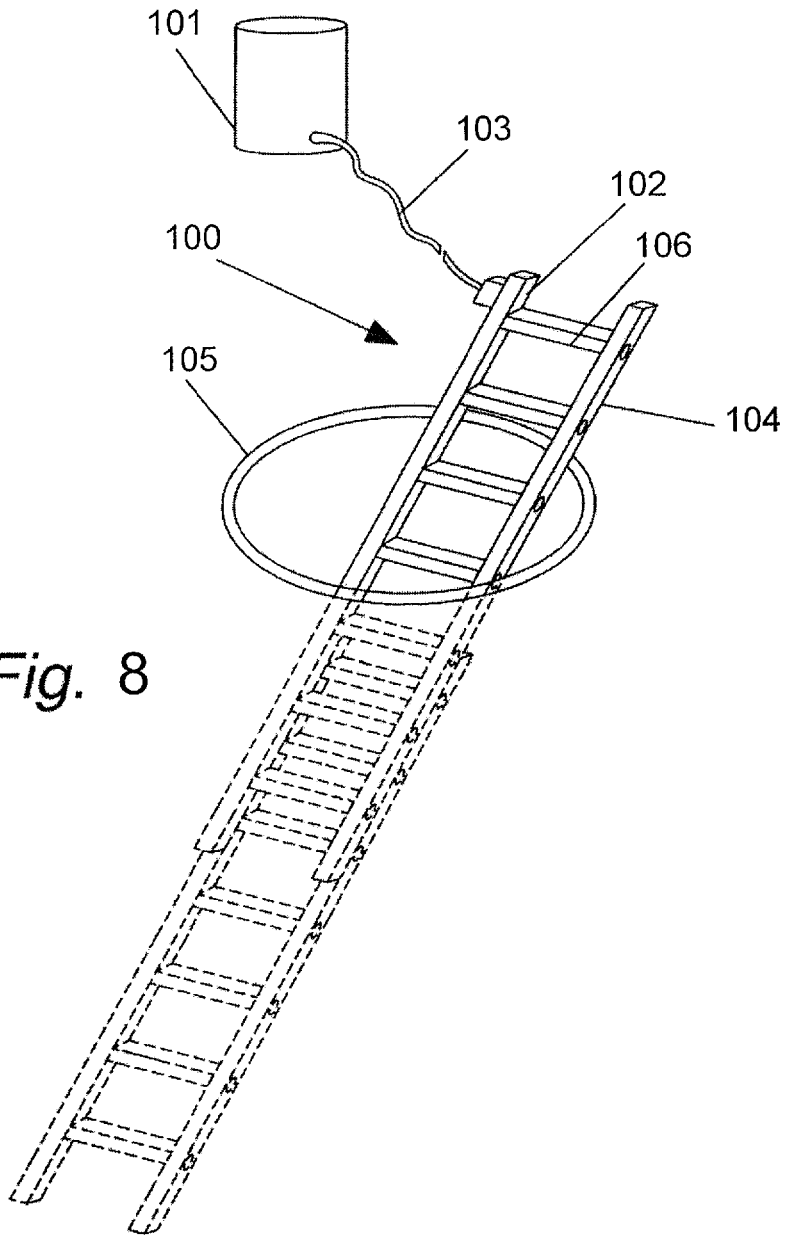
FIG. 8 is a pictorial view of the safety ladder in a manhole.
Figure 9:
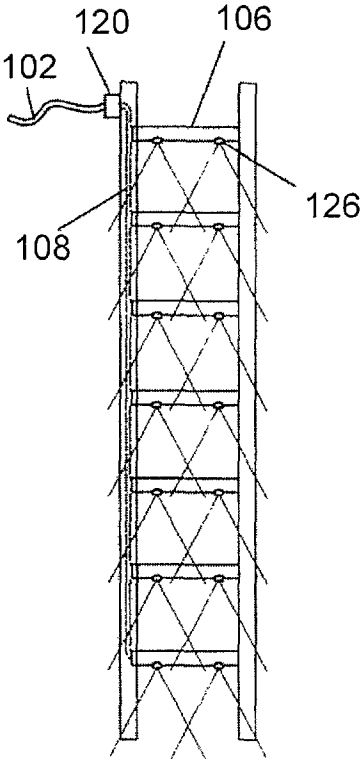
FIG. 9 is a front view of the safety ladder.

As shown in FIG. 9, multiple rungs 106 may include the use of a spray nozzle which can be all connected by the fluid conduit 108. The spray nozzle is directional, providing a spray pattern in front of and behind the ladder. A single rung along the top portion of the struts can be sufficient, however, as depicted in FIG. 8, a ladder that is not adjustable may be placed at different depths depending on different manhole or, in the case of firefighters, in positioning against a structure, so the actual preferred location of the spray nozzle in relation to a particular rung can vary from situation to situation. In the preferred embodiment, the ladder is made adjustable, wherein a first set of struts 102 are juxtapositioned to a second strut and made adjustable in a conventional manner. A coupling between the first strut 102 and second strut 104 can be made for the fluid conduit 108, not shown, allowing an adjustment in the ladder for proper height as needed in a particular situation, and more importantly, for placement of a spray nozzle 126 at an optimal position. In such a scenario the spray nozzle 126 would be located near the top rung to provide a showering effect for fire suppression, as will be further discussed in this specification.

Figure 10:
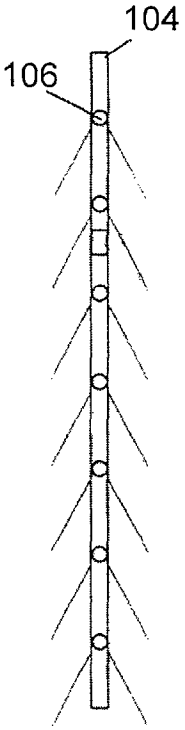
FIG. 10 is a side view of FIG. 9.

Nozzles can be placed at additional rungs, as depicted in FIGS. 9 and 10, and further, provisions can be made to make the individual rungs 106 inactive in situations where the rung 16 is extended outside the useful area, such as depicted in FIG. 8, where the top rung 106 is located outside the manhole 105. The spray nozzles 126 are constructed in arranged to distribute an amount of the fire suppressant composition in sufficient quantity to cover the individual, the ladder, and the immediate area beneath the manhole. If the individual's clothing is on fire, the admixture will extinguish the fire and suppress the spread of the fire. The admixture will also protect the individual's skin from exposure to the fire. Further, the admixture will inhibit the fire from damaging the integrity of the ladder so as to provide the individual with sufficient time to exit the manhole.

Structural rungs can be rotated with force to cause the spray nozzles to become inactive or rotated for purposes of allowing the spray nozzles to be active or directional. For instance, the rung 106 has the appearance of a conventional ladder rung extending between the first strut 102 and second strut 104 so as to maintain the struts in a spaced-apart position but, more importantly, provide structural support for the weight of an individual that climbs up and down the ladder. It is noted that this is a safety ladder and can be used for most any purpose, but when used in a position where individual safety is placed at risk, such as in a manhole where there are live electrical wires and possible fire, or for purposes of treating live fires in buildings, the container with a fire suppressant or compositions thereof would be installed, otherwise the ladder could be used in an ordinary, conventional manner. Preferably, the rungs are maintained in a fixed position, as the top of the rung 106 includes a surface texture 130 to make it a non-slip surface. It is contemplated that in an emergency situation the rung 106 needs to be as engaging as possible for the individual's hands and feet to prevent slippage while water is being poured on the individual and, in particular, the use of the applicant's admixture creates a slippery surface that is difficult to transverse if the individual is using the ladder and is not equipped with decent shoes. Surface texture 130 on the upper portion of the rung 106 eliminates slippage.

In a preferred embodiment, a plug 132 can be located on each rung so as to make the fluid conduit workable for the individual rung. In this embodiment, the plug 132 is rotatable 90 degrees wherein a first position allows fluid in the conduit to enter the rung 106, and then the plug 132 is rotated an additional 90 degrees, which prevents fluid from going into the individual rung. The spray nozzle 126 is preferably conical shaped so as to provide a cone of protection over the individual, should a fire occur. The unique properties of the admixture not only suppress fires, but when placed upon the skin, prevent burning of human flesh, allowing the individual time to exit the area where flash fires occur, such as the situation with manholes, as previously described.

A solenoid 120 having an inlet A is coupled to flexible pipe 102, with an outlet B coupled to the fluid conduit 108. The manual valve 140 can be rotated to allow the admixture to flow from the container 101 directly into the fluid conduit 108 whenever needed. The container 101 holds a mixture of a fire suppressant or compositions thereof and a predetermined amount of water to obtain an admixture. The container can be premixed or mixed on location. It is contemplated that the manual valve 140 is primarily used for flushing of the system after use, as the primary solenoid operation is preferably by use of remote triggering of the solenoid. The solenoid 120 has a battery operated coil 142 that, when energized, allows the admixture to bypass the manual valve 140 into inlet chamber B passing through the solenoid 120, through outlet chamber C into the fluid conduit 108. The battery operated coil 142 can be operated by a tethered trigger that can be held by a co-worker. For instance, in instances where the ladder is used in a manhole repair situation, the lineman who descends into the manhole would have a safety worker stand nearby, and should a fire erupt due to a flash fire or electrical arcing, the co-worker may trigger a remote switch 144 to cause operation and opening of the solenoid 120 to insert the admixture into the ladder structure. Similarly, the lineman himself may include a tethered remote 146 that can be drawn into the manhole and activated by the lineman should the need occur. Further, a remote transmitter 148 can be used, operating on a radio frequency to a receiver located on the battery operated solenoid 120 to allow for opening of the solenoid remotely, without the need for tethered switches. A considerable drawback to the use of a radio frequency transmitter is the loss of signal should the lineman leave the ladder wherein the ground operates as a frequency deadening device which could cause the ladder to be inoperational. However, by the use of a stronger transmitter, such as a 2.5 GHz transmitter, should be suitable for most conditions. The ladder is designed as a safety function and the farther the ladder is removed from the lineman, the ability of the safety function is lessened, as is the ability of the transmitter to function.

Ladder construction is preferably of a non-metallic material allowing the ladder to be used in universal application including electrical situations that would otherwise be improper due to the conductive nature of metal. In addition, the fluid properties of the admixture do not provide conductivity in instances of an electrical short, whereas a regular ladder that is being doused with water can cause electrocution of the individual. Preferred strut material would be fiberglass or basalt and the rungs can remain aluminum, as they are spaced apart and positioned with non-conductive struts.

Quick connect couplings are used to connect the fluid hose 108 to the solenoid 120. This allows the ladder to be used in its conventional manner. When the ladder is used in a location where fire is possible, the quick connect couplings turn the ladder into a safety ladder capable of providing fire suppression.

A variation of the cabled remote is the use of a wireless transmitter 48 which works on a radio frequency. The transmitter would signal a receiver 121 mounted to the solenoid 120 that would signal the solenoid mounted receiver to open the valve. At a minimum, a 2.4 GHz transmitter should be suitable for most every situation. Battery condition of the solenoid, whether operated by a cabled trigger switch or a wireless transmitter can be verified by use of an indicator light that indicates the condition of the battery is sufficient for operation. Another light indicator can be employed to verify the container is filled with fluid and pressurized. Lithium battery technology would allow a replacement period expected to exceed ten years as the system is to be used only for emergencies and, the battery draw during that time would be limited to low draw LED operational indicator lights.

In a preferred embodiment, the wireless remote 148 is mounted to a wrist band that can be positioned around an individual's wrist before they enter the manhole. A proximity sensor can be used to assure the transmitter and receiver 121 is within operating range, with a flashing light on the both the solenoid 120 and the receiver 121 to indicate if the devices are out of range. It should be noted that while a wrist band is described, any type of attachment convenient to the individual is contemplated including a pendant worn around the neck and belt attachment similar to a garage door opener bracket.

As previously mentioned, electrical arcing may occur at any time and the larger volume of air allowed by the removal of the manhole cover may result in an unexpected fire burst. The removal of the manhole cover may allow a volume of air to enter the area to support full blown combustion. It should be noted that even if an electrical grid is turned off for inspection, a smoldering fire may irrupt irrespective of the presence of electricity. In manholes that lead to tunnels, the worker may leave the second remote at the bottom of the ladder. Should a fire occur, the worker that returns to the ladder can active the system providing a shower of fire suppressant material that will give him the time necessary to escape the manhole.

The viscosity of the admixture of fire suppressant or compositions thereof allows attachment to whatever is spayed and the admixture will not move or migrate past the area into which it was introduced. Therefore, the admixture can be delivered to a specific area within a tunnel and it will remain in that area and will not flow into areas that are not sprayed. Spraying the individuals clothing and exposed skin is most preferred, the admixture provides fire extinguishing qualities also provides fire and heat suppressant properties. Further, once the individual is within the spray area, noxious and/or toxic gasses are entrapped again providing the individual with additional time to exit the manhole.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An improved safety ladder for use in servicing underground utilities, said safety ladder formed from a pair of elongated parallel placed rails constructed from a non-conductive material having an inner surface to receive a plurality of transverse rungs extending therebetween, said improvement comprising:

at least one fluid conduit extending along a length of at least one said rail;

spray nozzles secured to at least one said rung fluidly attached to said fluid conduit wherein said spray nozzles are arranged to provide overlapping spray patterns;

a container having an admixture comprising a predetermined amount of a fire suppressant or compositions thereof coupled to said fluid conduit, said admixture is non conductive and capable of suppressing an electrical fire;

at least one battery operated solenoid positioned in said fluid conduit between said container and said fluid conduit;

activation means for engaging said battery operated solenoid in the event of a fire to allow said admixture to pass through said solenoid for distribution through said fluid conduit and said spray nozzles; wherein said spray nozzles are directed to expel said admixture in the overlapping pattern over a worker standing on a rung or juxtapositioned to a rung in the event of a fire.

2. The safety ladder according to claim 1 wherein said activation means includes at least one remote trigger capable of opening said solenoid.

3. The safety ladder according to claim 2 wherein said remote trigger is electrical coupled to said solenoid.

4. The safety ladder according to claim 2 wherein said remote trigger is coupled to said solenoid by a wireless connection.

5. The safety ladder according to claim 1 wherein each said spray nozzle is positioned along a bottom surface of said rung when said struts are in a substantially vertical position.

6. The safety ladder according to claim 1 wherein an upper surface of each said rung includes a surface structure to inhibit slippage.

7. The safety ladder according to claim 1 including a temperature sensor secured to said ladder and electrically coupled to said solenoid, said temperature sensor automatically opening said solenoid when subjected to heat.

8. The safety ladder according to claim 1 including a temperature sensor secured to each said spray nozzle, said temperature sensor automatically releasing admixture to said nozzles when subjected to heat.

* * * * *